United States Patent [19]

Basil

[11] 4,145,048

[45] Mar. 20, 1979

[54] CONCENTRIC BASKETLIKE TARGET GAME

[76] Inventor: Samuel C. Basil, 1542 E. Willetta, Phoenix, Ariz. 85006

[21] Appl. No.: 784,506

[22] Filed: Apr. 4, 1977

Related U.S. Application Data

[63] Continuation of Ser. No. 635,371, Nov. 26, 1975, abandoned.

[51] Int. Cl.[2] ..... A63B 63/00; A63B 59/00

[52] U.S. Cl. ..... 273/95 R; 273/67 R; 273/105 R

[58] Field of Search ..... 273/73 R, 73 H, 80 B, 273/80 R, 72 A, 67 DB, 67 DC, 67 A, 67 R, 72 R, 67 D, 67 DA, 105 R, 105 A

[56] References Cited

U.S. PATENT DOCUMENTS

| | | | |
|---|---|---|---|
| 532,132 | 1/1895 | Zaremba | 273/105 R |
| 1,532,186 | 4/1925 | Klein | 273/95 R |
| 2,147,502 | 2/1939 | Savage | 273/105 A |
| 2,544,450 | 3/1951 | Enos | 273/72 A |
| 2,895,737 | 7/1959 | Blees | 273/26 A |
| 3,365,196 | 1/1968 | Miller | 273/105 R |
| 3,479,030 | 11/1969 | Merola | 273/72 A |
| 3,530,048 | 9/1970 | Darrow | 273/80 R |
| 3,841,130 | 10/1974 | Scott et al. | 273/72 A |
| 3,880,423 | 4/1975 | Kreag | 273/67 DC |

FOREIGN PATENT DOCUMENTS

| | | | |
|---|---|---|---|
| 1910844 | 3/1969 | Fed. Rep. of Germany | 273/105 R |
| 4427 of | 1905 | United Kingdom | 273/105 R |
| 926165 | 5/1963 | United Kingdom | 273/80 B |

*Primary Examiner*—William H. Grieb
*Assistant Examiner*—Lawrence E. Anderson
*Attorney, Agent, or Firm*—Shlesinger, Arkwright, Garvey & Dinsmore

[57] ABSTRACT

Game apparatus comprising a basketlike target held by a support in spaced relation to the ground, a ball, and a bat having a flat ball-engaging surface for employing the ball towards the target when the ball is thrown into the air and struck thereby. The bat is of one or two piece construction. When made of one piece construction, one end of the tubular piece of material is swaged to form a handle and the other end thereof is flattened to provide a ball-engaging surface. When made of two pieces, an elongated flat piece of material is fixed to a tubular piece of material, a portion of the latter extending beyond the flat piece of material to provide a handle.

2 Claims, 13 Drawing Figures

CONCENTRIC BASKETLIKE TARGET GAME

This is a continuation of application Ser. No. 635,371, filed Nov. 26, 1975, now abandoned.

BACKGROUND AND OBJECTS

Recreational sports, and in particular golf, have become increasingly popular over the years. It is well known, however, that the construction of a golf course requires a large tract of land on which the course may be laid out. Additionally, the installation of trees, fairways, sand traps, greens, etc., is very costly and the maintenance thereof requires constant manpower. As a consequence, the individual golf player must pay a substantial amount in green fees to play a round of golf. In addition, each player must have a set of clubs, which also involves a large expenditure of money. As a result of the high cost of playing golf, many individuals can no longer afford to play the game and must look to other games for recreation.

In U.S. Pat. No. 1,419,554, granted to Franklin W. Ganse on June 13, 1922, there is disclosed a recreational game which bears some resemblance to golf, but wherein a considerably smaller tract of land may be used. In accordance with the Ganse patent, a ball is thrown into the air and hit with a tennis racket in the direction of a ball-receiving vertically disposed, rotatable net situated a predetermined distance from the starting point. The number of "swings" taken to hit the ball into the net are then counted in a manner similar to the game of golf. A number of spaced nets comprise a course and the player proceeds from one net to another in playing a round. Since there are no tees, fairways, greens or sand traps, the installation and maintenance of such a course is minimal. Additionally, only one batting implement is required as opposed to a set of clubs which are necessary to play golf.

It is an object of the present invention to provide an improved game apparatus for playing a game of the type shown and described in U.S. Pat. No. 1,419,544, the apparatus including a horizontally disposed, basketlike target a predetermined distance from the ground, a ball and batting implement for hitting the ball into the net.

Another object is to provide a game apparatus of the character described, the components of which are simple, economic construction, the ball and batting implement being so constructed that the ball will only travel a certain maximum distance, in order that the course may be laid out accordingly.

Further objects are to provide a game apparatus of the character described, including a batting implement of one piece or two piece construction made of simple, inexpensive parts and readily adaptable for manufacturing in different lengths; to provide a process for manufacturing a bat from a tubular piece of material, the one end of which is swaged to provide a handle and the other end of which is flattened to provide a ball-engaging surface, and to provide a process for making a bat wherein an elongated flat piece of material is secured to a tubular piece of material, a portion of the latter extending beyond the elongated flat piece of material to provide a handle.

Other objects will be apparent from the following description of the presently preferred forms of this invention.

DESCRIPTION OF FORM OF INVENTION ILLUSTRATED IN FIGS. 1 TO 9

Figures 1, 2, 3, 4, 5, 6, 10, 11, 12, 13:
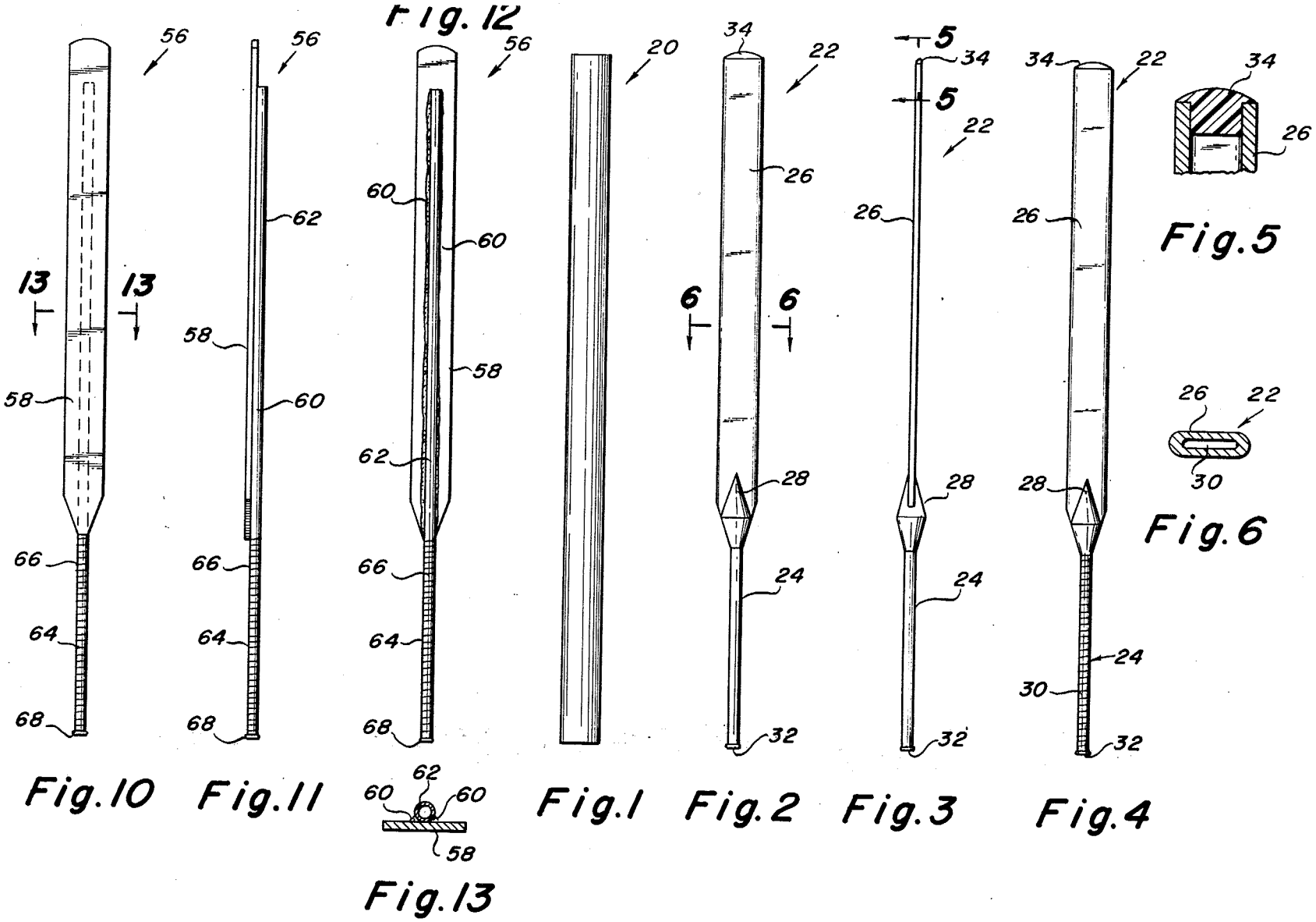
FIG. 1 is an elevational view of tubular material for making a bat in accordance with the present invention.
FIG. 2 is a front elevational view of a bat formed from the tubular material of FIG. 1.
FIG. 3 is a side elevational view of the bat of FIG. 2.
FIG. 4 is a rear elevational view of the bat with hand grip applied thereto.
FIG. 5 is a sectional view taken along the line 5—5 of FIG. 3, looking in the direction of the arrows.
FIG. 6 is a sectional view taken along the line 6—6 of FIG. 2, looking in the direction of the arrows.
FIG. 10 is a front elevational view of a modified form of the present invention.
FIG. 11 is a side elevational view of the bat of FIG. 10.
FIG. 12 is a rear elevational view of the bat of FIG. 10.
FIG. 13 is a sectional view taken along the line 13—13 of FIG. 10.

Referring now in greater detail to the drawings, there is shown in FIG. 1 a tubular piece of material 20 of aluminum alloy from which the bat of the present invention forming a part of the game apparatus is to be made. This material may be twenty-eight to thirty-six inches in length, and is preferably one and three-eighths to one and one-half inches in diameter.

In FIGS. 2 to 6, there is illustrated the bat of the present invention formed from tubular material 20, which bat is generally designated 22. Bat 22 comprises a handle 24 which is formed by swaging a part of tubular material 20 by conventional means, which handle extends for a distance of ten to twelve inches and is of approximately three-quarters inch in diameter for easy gripping.

Bat 22 further includes a flat ball-engaging surface 26 which is preferably eighteen inches to twenty-four inches in length which is formed by placing the tubular stock beyond the handle 24 in a press. This leaves an enlarged portion 28 between handle 24 and ball-engaging surface 26. Flat surface 26 is approximately two inches in width to provide a substantial surface for hitting a ball. The flattening of the tubular material forms a hollow area 30 within the bat which is approximately one-eighth inch in width, with the result that the flattened portion 26 is approximately five-sixteenths of an inch thick.

In order to complete bat 22, the aluminum is anodized, following which a hand grip 30, such as used for baseball bats, is applied to handle 24. To finish the bat, a plastic plug 32 is placed in the handle terminal of the bat and a second plastic plug 34 is placed in the opposite terminal thereof. This gives the bat a finished look and prevents water, dirt and other foreign materials from getting inside the bat.

Figure 9:
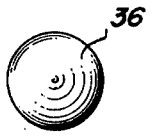
FIG. 9 is a plan view of a ball forming a part of the present game apparatus.

In FIG. 9, there is disclosed a ball designated 36 used in conjunction with bat 22. This ball is preferably of hollow, plastic construction approximately two and one-half inches in diameter. Such construction permits the ball to be hit fifty or sixty yards in the air, and therefore is not out of view of the players. This type of ball further permits the course to be laid out in accordance with the known maximum distance which the ball can be hit.

Figure 7:
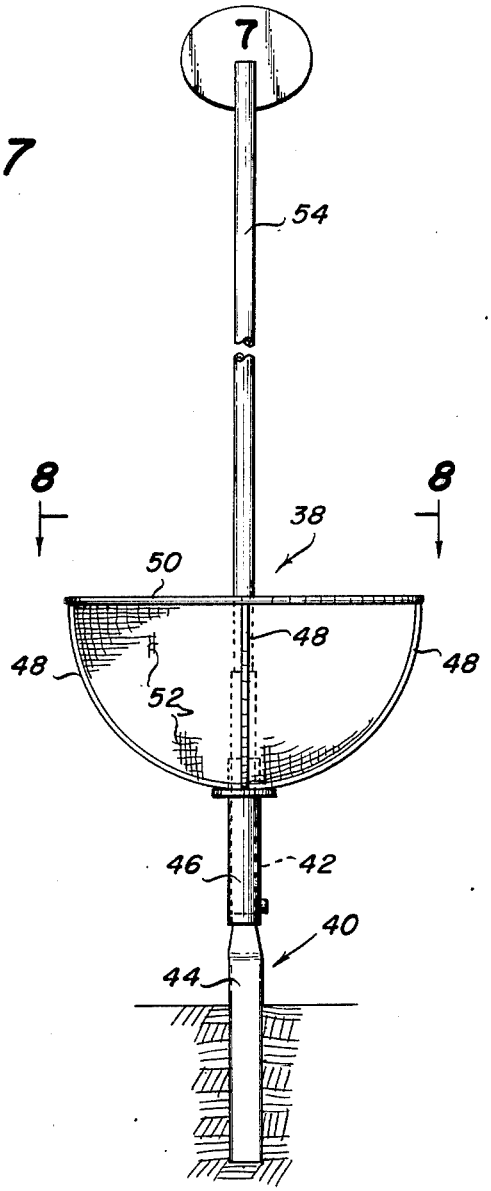
FIG. 7 is an elevational view of a basketlike target made in accordance with the present invention.
Figure 8:
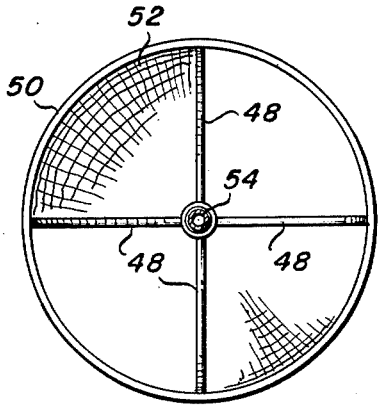
FIG. 8 is a sectional view taken along the line 8—8 of FIG. 7, looking in the direction of the arrows.

In FIGS. 7 and 8, there is shown a basketlike target or so-called raque 38 into which ball 36 is to be hit by the player. Raque 38 includes a holder or support 40 comprising a tubular portion 42 and a flattened portion 44, the latter being adapted to facilitate insertion thereof into the ground. A tubular frame support 46 is sleeved over tubular portion 42 of holder 40 to which is secured a plurality of spaced arcuate braces 48, the upper ends of the arcuate braces being fixed to a circular hoop 50. As shown to advantage in FIGS. 7 and 8, a net 52 is suspended from hoop 50 in any suitable fashion and hangs downwardly between braces 48. A flag 54 is inserted into frame support 46 and extends downwardly within the confines of holder 40 to flattened portion 44.

In use of the apparatus of the present invention, a plurality of the basketlike targets are placed on a tract of land in spaced relation to each other, following which the players hit ball 36 in the direction of the targets in a predetermined order starting at a baseline and throwing the ball into the air and striking it with bat 22 as many times as is necessary to hit it into each raque 38. The number of "swings" is counted and the players then proceed to the next target in a manner similar to the game of golf.

DESCRIPTION OF FORM OF INVENTION ILLUSTRATED IN FIGS. 10 TO 13

In FIGS. 10 to 13 there is illustrated a modified form of bat constructed in accordance with the present invention which bat is designated 56. This bat includes an elongated flat metal piece made of aluminum or the like and approximately twenty-four inches long and two inches wide made of aluminum plate one-eighth inch thick is welded at 60 to a rod 62 which is approximately three-quarters inch in diameter and extends longitudinally and centrally of plate 58 from a point adjacent one terminal thereof to a point approximately ten or twelve inches beyond the opposite terminal of the plate. This in turn provides a handle 64 which may be covered by a hand grip 66. A plug 68 is inserted into the handle end of pipe 62.

The game apparatus of the present invention is particularly adapted for use in playing BATARAQUE wherein ball 36 is repeatedly hit by bat 22 or 56 into the designated raque 38 in a manner described above. However, if desired, the apparatus could also be used in playing other games.

The game apparatus of the present invention is economical to manufacture since it is made from simple parts which, may be readily obtained. The bat of the present invention is of one or two piece construction, and the component portions of the bat are formed in a minimum of two steps. The construction of the bats further permits them to be made of different length for use by individuals of all ages and sizes.

The raque is also made from a few readily assembled partes, which further contributes the economy of manufacture.

In view of the low cost of the present game apparatus and the relatively small expenditure for laying out a BATARAQUE course, a recreational sport for all ages is provided which is within the means of all to play.

While there has been herein shown and described the presently preferred forms of the invention, it is to be understood that such has been done for purposes of illustration only, and that various changes may be made within the scope of the appended claims.

What is claimed is:

1. Game apparatus including:
(a) a basketlike target comprising a vertical support
(b) said vertical support comprising a longitudinal tubular portion and a longitudinal flattened portion, said flattened portion facilitating insertion thereof into the ground
(c) said basketlike target further including a tubular frame support in sleeved engagement with the tubular portion of said vertical support and extending longitudinally thereof to a point proximate the flattened portion of the vertical support
(d) a flag including a tubular member inserted into the longitudinal tubular portion of said vertical support and extending downwardly to said flattened portion of the latter
(e) a hoop in spaced, concentric relation to said tubular frame support and disposed in a plane at a right angle to the longitudinal axis of said vertical support and frame support
(f) a plurality of spaced braces, the terminals of which are fixed to said hoop and tubular framed support respectively, and
(g) a net suspended from said hoop and hanging between said braces.

2. Game apparatus including a bat, ball and basketlike target
(a) said bat being of unitary construction and formed from an elongated tubular piece of metallic material
(b) one end of said tubular piece of metallic material having a swaged portion providing a bat handle
(c) the other end of said metallic piece of material being flattened to provide a portion with walls having substantially flat, parallel ball-engaging surfaces on two opposite sides
(d) the flattened portion of said tubular material having approximately five-sixteenths of an inch thick throughout substantially the entire length and width thereof leaving a hollow area of approximately one-eighth of an inch in width between the walls of the flattened portion, and
(e) a basketlike target comprising a vertical support
(f) said vertical support comprising a longitudinal tubular portion and a longitudinal flattened portion, said flattened portion facilitating insertion thereof into the ground
(g) said basketlike target further including a tubular frame support in sleeved engagement with the tubular portion of said vertical support and extending longitudinally thereof to a point proximate the flattened portion of the vertical support
(h) a flag including a tubular member inserted into the longitudinal tubular portion of said vertical support and extending downwardly to said flattened portion of the latter
(i) a hoop in spaced, concentric relation to said tubular frame support and disposed in a plane at a right angle to the longitudinal axis of said vertical support and tubular frame support
(j) a plurality of spaced braces, the terminals of which are fixed to said hoop and tubular frame support respectively
(k) said basketlike target further including a net suspended from said hoop and hanging between said braces whereby the ball may be struck repeatedly by the bat until it is hit into the basketlike target.

* * * * *